United States Patent [19]

English

[11] 4,360,200

[45] Nov. 23, 1982

[54] GOLF FLAG STICK HOLDER

[75] Inventor: John A. English, Sausalito, Calif.

[73] Assignee: Green-Gard Associates, Larkspur, Calif.

[21] Appl. No.: 327,419

[22] Filed: Dec. 4, 1981

[51] Int. Cl.[3] ..... A63B 57/00

[52] U.S. Cl. ..... 273/34 R

[58] Field of Search ..... 273/34 R, 34 A, 34 B; 116/173, 174, 175

[56] References Cited

U.S. PATENT DOCUMENTS

| | | | |
|---|---|---|---|
| 1,329,732 | 2/1920 | Verity | 273/34 R |
| 1,568,320 | 1/1926 | Coldwell | 273/34 R |
| 1,608,744 | 11/1926 | Hirt | 273/34 R |
| 1,744,985 | 1/1930 | Picha | 273/34 R |
| 3,225,734 | 12/1965 | Bule | 116/173 |
| 3,348,797 | 10/1967 | Turbyfill | 273/34 R X |
| 3,360,224 | 12/1967 | Baumann | 273/34 R X |
| 3,511,501 | 5/1970 | Sandberg | 273/34 R |
| 4,149,719 | 4/1979 | Wakefield | 273/34 R |

*Primary Examiner*—George J. Marlo

[57] ABSTRACT

A golf flag stick holder for insertion into a golf cup and having a central member with a plurality of laterally extending arms with upright fingers at the outer ends of the arms, and having removal plastic inserts at the outer edges of the fingers so that the inserts define the periphery of the holder for sliding insertion of the holder into and withdrawal from a golf cup.

6 Claims, 4 Drawing Figures

GOLF FLAG STICK HOLDER

BACKGROUND OF THE INVENTION

This invention relates to golf cups and in particular, to a new and improved holder for the golf flag stick. The conventional golf cup has a central tube which is supported in an outer sleeve by a spider arrangement. The outer sleeve fits into a hole in the green, and the base of the flag stick slides in the inner tube. This construction is shown in FIG. 1 of the drawing.

Repeated insertion and removal of the stick produces wear both at the base of the stick and at the tube of the cup. This results in tilting of the stick which gives ambiguous or erroneous information to the golfer and also which damages the lip of the cup when the stick rests against the lip.

One solution to this problem is proposed in U.S. Pat. No. 1,568,320. In this design, a base in the form of a closed cup has a central tube for receiving the stick which is clamped in the tube. The base is described as a heavy casting which slides into and out of the standard cup.

This design will meet the problem of the caddy making holes in the green with the lower end of the conventional stick. However as the base and cup wear with repeated use, the tilting problem will be present as with the conventional flag stick and cup. In both instances, when the tilt becomes excessive, the cup and the stick in the case of the conventional design and the cup and the base in the case of the prior patent design will have to be replaced. This is both expensive and undesirable.

Accordingly it is an object of the present invention to provide a new and improved golf flag stick holder which will have minimum wear and which will maintain the stick upright. A further object is to provide such a holder incorporating removable wear elements which are quickly and inexpensively replaced permitting stick positions in a course to be maintained in prime condition at minimum expense.

Other objects, advantages, features and results will more fully appear in the course of the following description.

SUMMARY OF THE INVENTION

A golf flag stick holder for insertion into a golf cup and comprising a central member with a plurality of laterally extending arms with an upright finger at the outer end of each arm, with each of the fingers having a passage at the outer edge thereof with a plastic insert therein, with the inserts defining the periphery of the holder for sliding insertion of the holder into and withdrawal from a golf cup. The holder also includes means for receiving a flag stick in the central member, preferably a rod fixed in the central member with a sleeve at the upper end for sliding insertion of the conventional stick. In the preferred embodiment, the inserts are slidable into and removable from the passage, with a pin for holding the inserts in place thereby providing for ease of replacement.

DESCRIPTION OF THE PREFERRED EMBODIMENT

Figure 1:
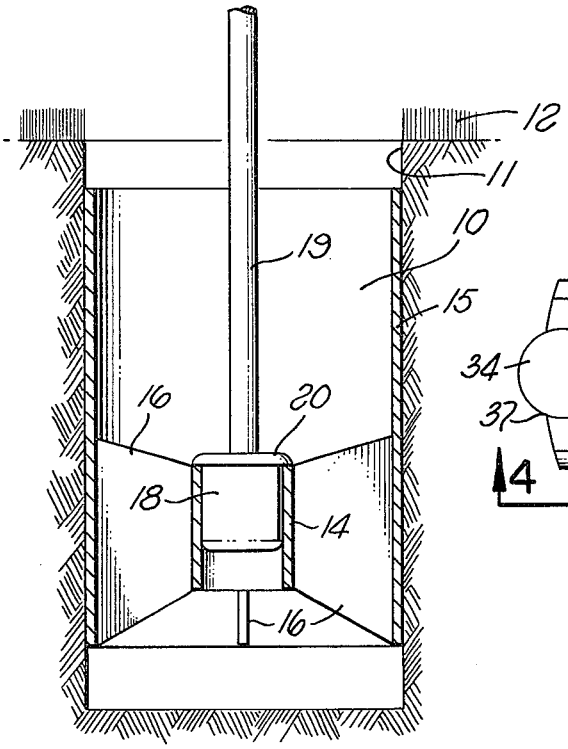
FIG. 1 PRIOR ART
FIG. 1 is a vertical section through a conventional golf cup with flag stick holder inserted.

A conventional golf cup is illustrated in FIG. 1 where the cup 10 is slid into a hole 11, usually with the upper edge of the cup below the lip of the green 12. The cup 10 includes an inner tube 14 supported centrally in an outer sleeve 15 by a plurality of ribs 16 which function as a spider to support the inner tube. A ferrule or sleeve 18 is mounted at the lower end of a golf stick 19, with the ferrule having a lip or rim 20 to limit downward sliding of the ferrule into the tube 14.

The stick is removed from and replaced in the cup many times during a day's play with a resultant wear of the ferrule 18 and 14. As a result, the stick tilts in the cup and both the cup and the stick with ferrule have to be replaced in order to have an upright stick.

Figure 3:
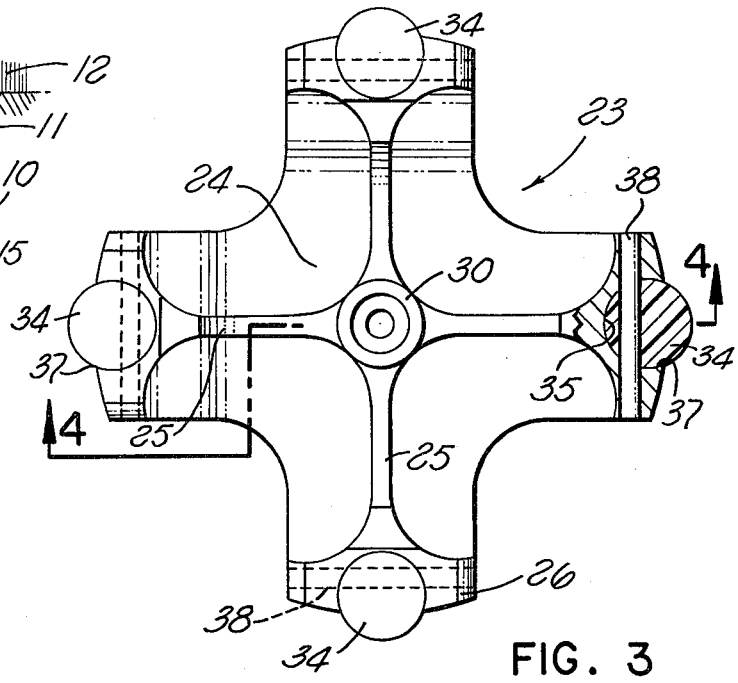
FIG. 3 is an enlarged top plan view, partly in section, of the flag stick holder of FIG. 2.
Figure 2:
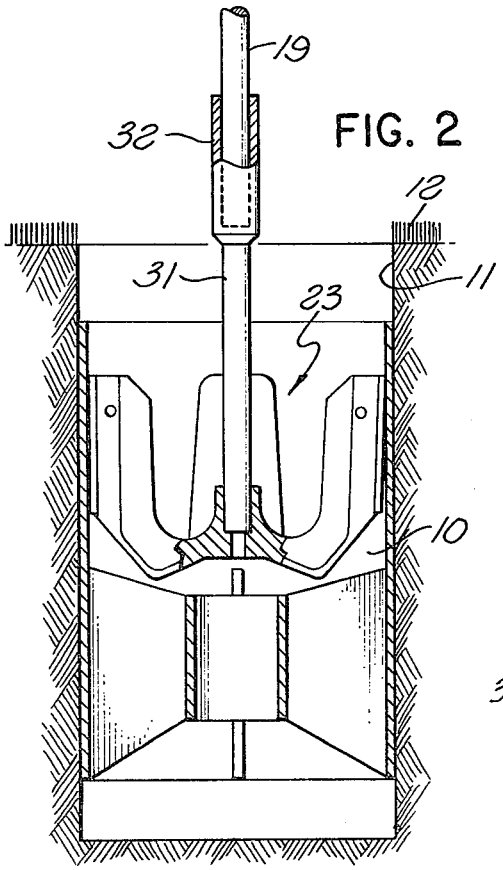
FIG. 2 is a view similar to that of FIG. 1 showing the presently preferred embodiment of the invention.
Figure 4:
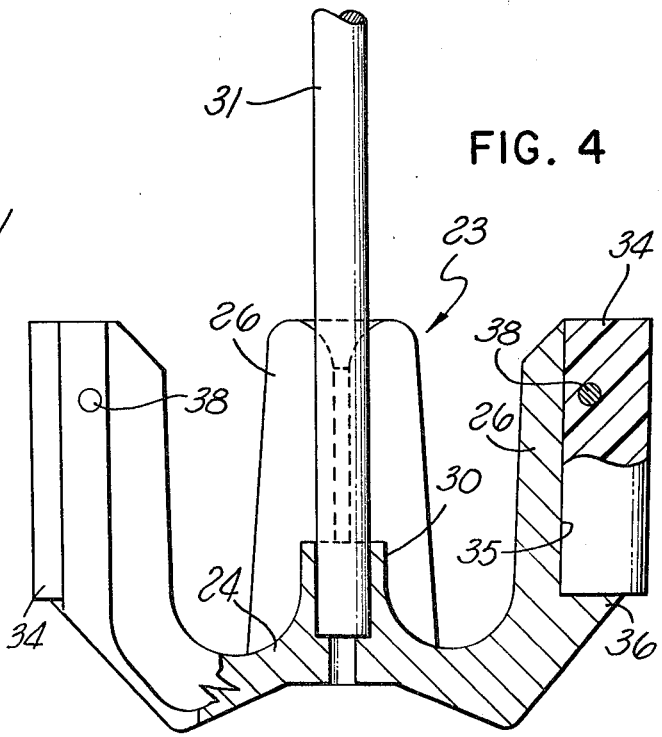
FIG. 4 is a sectional view taken along the line 4—4 of FIG. 3.

The stick holder 23 of the present invention, as shown in FIGS. 2–4, has a central section 24 with four laterally extending arms 25 and with an upright finger 26 at the outer end of each arm. The holder 23 preferably is an aluminum casting, but may be made of other material as desired.

Means are provided in the holder for supporting a golf stick 19. In the embodiment illustrated, a boss 30 projects upward from the central section 25, with an opening in the boss for receiving a rod 31. The rod is fixed in the boss, typically by welding or brazing. A sleeve 32 is provided at the upper end of the rod 31 for receiving the lower end of the flag stick 19. Typically the flag stick is fixed in the sleeve by cementing.

Inserts 34 are positioned in passages 35 in the fingers 26. In the embodiment illustrated, the inserts 34 are cylindrical rods which slide downward in cylindrical passages cast or machined in the fingers. Preferably the passages are closed or partly closed at the lower ends by portions 36 of the holder which serve as stops. The passages 35 have openings 37 at the outer edges, so that the inserts project outward beyond the holder. Preferably, the distance across the openings 37 is less than the maximum width of the passages so that the inserts are restrained from lateral movement. Also, it is desirable to provide means for fixing the inserts in place, as by means of transverse pins 38 which pass through aligned openings in the fingers and inserts. While cylindrical inserts are shown, it will be understood that other shapes for the inserts may be utilized as desired.

The inserts 34 define the periphery of the holder, with the inserts engaging the inner surface of the sleeve 15 of the cup. It is preferred that this outer periphery taper toward the bottom to a slight degree so that there will be a snug fit between the holder and the cup. This may be achieved by utilizing inserts of uniform size, with the passages tapering, as shown in FIG. 4. Alternatively, the passages may be parallel with the inserts having a taper.

In a typical installation, the holder 24 is produced with the four inserts 34 and the rod 31 at the place of manufacture. The sticks 19 may be inserted in the sleeves 32 of the holders at the golf course or also may be installed at the place of manufacture. At the place of use at the golf green, the holder is inserted into the cup as shown in FIG. 2 with the inserts engaging the sleeve of the cup and providing an upright stick. During initial wear of the inserts, the holder will merely rest further down in the cup. However there will come a time when the inserts are so worn that an undesirable tilt of the stick occurs. Then the stick with holder may be taken to the club house, the worn inserts removed and new inserts installed, and the holder is again ready for use.

I claim:

1. A golf flag stick holder for insertion into a golf cup, comprising:

a central member and a plurality of laterally extending arms with an upright finger at the outer end of each arm, and means for receiving a flag stick in said central member, each of said fingers having a passage at the outer edge thereof with a plastic insert therein, with said insert defining the periphery of said holder for sliding insertion of the holder into and withdrawal from a golf cup.

2. A flag stick holder as defined in claim 1 including means for holding said inserts in said respective passages.

3. A flag stick holder as defined in claim 1 wherein each of said passages is open at one end for sliding insertion of said insert, with a stop at the other end for limiting insert movement.

4. A flag stick holder as defined in claim 1 including a pin passing through the finger and insert for holding the insert in the passage.

5. A flag stick holder as defined in claim 4 wherein said means for receiving a flag stick comprises a rod carried in and projecting upward from said central section and having a sleeve at the upper end thereof for sliding insertion of a flag stick.

6. A golf flag stick assembly for insertion into a golf cup, including in combination:

a central member and a plurality of laterally extending arms with an upward finger at the outer end of each arm, each of said fingers having a passage at the outer edge thereof with a plastic insert therein, with said insert defining the periphery of said holder assembly for sliding insertion into an withdrawal from a golf cup; and a golf flag stick mounted in said central member.

* * * * *